US009666107B2

(12) United States Patent
Van Pieterson et al.

(10) Patent No.: US 9,666,107 B2
(45) Date of Patent: May 30, 2017

(54) FABRIC COVER LAYER FOR DISPLAY DEVICE

(75) Inventors: Liesbeth Van Pieterson, Eindhoven (NL); Sima Asvadi, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 1116 days.

(21) Appl. No.: 12/532,454

(22) PCT Filed: Mar. 27, 2008

(86) PCT No.: PCT/IB2008/051136
§ 371 (c)(1),
(2), (4) Date: Sep. 22, 2009

(87) PCT Pub. No.: WO2008/120142
PCT Pub. Date: Oct. 9, 2008

(65) Prior Publication Data

US 2010/0085753 A1 Apr. 8, 2010

(30) Foreign Application Priority Data

Mar. 30, 2007 (EP) ..... 07105284

(51) Int. Cl.
*F21V 21/08* (2006.01)
*G09F 21/02* (2006.01)
*G09F 9/33* (2006.01)

(52) U.S. Cl.
CPC ..... *G09F 21/02* (2013.01); *G09F 9/33* (2013.01)

(58) Field of Classification Search
USPC ..... 362/103, 249.02, 382, 341
See application file for complete search history.

(56) References Cited

U.S. PATENT DOCUMENTS

| | | | | |
|---|---|---|---|---|
| 6,551,726 | B1 * | 4/2003 | Burrows | 428/690 |
| 7,267,452 | B2 * | 9/2007 | Esses | 362/103 |
| 7,274,844 | B2 * | 9/2007 | Walt et al. | 385/38 |
| 7,431,975 | B2 * | 10/2008 | Zafiroglu | 428/98 |
| 2006/0007059 | A1 | 1/2006 | Bell | |
| 2006/0082987 | A1 * | 4/2006 | Dorsey et al. | 362/103 |
| 2006/0207139 | A1 | 9/2006 | Deflin et al. | |
| 2007/0053179 | A1 * | 3/2007 | Pang et al. | 362/103 |
| 2007/0182666 | A1 * | 8/2007 | Hochman et al. | 345/46 |

FOREIGN PATENT DOCUMENTS

| | | | |
|---|---|---|---|
| GB | 2396252 | A | 6/2004 |
| JP | 11249608 | A | 9/1999 |
| JP | 2006524834 | A | 11/2006 |
| WO | 2006129244 | A2 | 12/2006 |
| WO | 2006129246 | A2 | 12/2006 |

* cited by examiner

*Primary Examiner* — Andrew Coughlin
*Assistant Examiner* — Jessica M Apenteng

(57) ABSTRACT

A display device comprising a substrate (100) accommodating at least one light emitting electro-optical device (101) and a fabric layer (102) arranged on said substrate (100) to receive at least part of the light emitted by said at least one light emitting electro-optical device (101) is provided. The backside (103) of said fabric layer is provided with at least one self-supporting recess (104), and said fabric layer (102) is arranged such that said at least one recess (104) is located in front of said at least one light emitting electro-optical device (101). A gap (108) separates said at least one light emitting electro-optical device (101) from the fabric material within said at least recess (104).

11 Claims, 1 Drawing Sheet

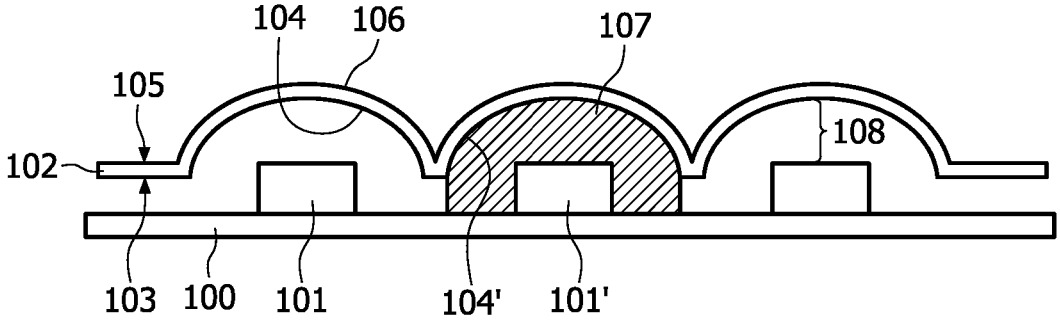
104
106
107
105
108
102
103
100
101
104'
101'

FABRIC COVER LAYER FOR DISPLAY DEVICE

FIELD OF THE INVENTION

The present invention relates to a display device comprising a substrate accommodating at least one light emitting electro-optical device and a fabric layer arranged on said substrate to receive at least part of the light emitted by said at least one light emitting electro-optical device.

BACKGROUND OF THE INVENTION

The applications of flexible display devices are currently increasing. For example, flexible display devices have been integrated into textiles to form textile lighting systems, such as clothing and furniture with integrated displays.

Display devices suitable for integration in textile products typically utilized light emitting diodes (LEDs) as light sources. LEDs essentially constitute point sources and often emit light in a half sphere pattern.

One example of a lighting device which is incorporated in textiles, for the use as curtains, wall-hanging objects and the like, is disclosed in US2006/0082987 A1 (Dorsey et al), which discloses at least one light emitting diode and at least one sheet of fabric covering the at least one light emitting diode, so that light emitted from the at least one light emitting diode is able to shine through the at least one sheet of fabric.

In the device of US2006/0082987 A1, a first layer of fabric is arranged directly on the light emitting diodes in order to diffuse the light emitted from the LEDs and to provide a soft feel of the device. However, the light output of such a device will drastically change when it is subjected to mechanical influence, such as pressure, bending and stretching forces. The diffusing fabric layer will easily be compressed so that for example the diffusing action is reduced. Thus, such a lighting device is not suited for wearable applications or the like, where it regularly will be subjected to mechanical forces. Further, for good diffusion, would be desirable to have the diffusing material at a certain distance from the light emitting diodes.

Hence, there is a need in the art for a display device, suitable for wearable applications, whose optical properties are less influenced by mechanical forces.

SUMMARY OF THE INVENTION

It is an object of the present invention to at least partly overcome the above-mentioned problem, and to provide a display device suitable for incorporation in a textile product, which provides diffused illumination.

This and other objects of the present invention are achieved by a display device as described herein and as defined in the appended claims.

Hence, in a first aspect, the present invention provides a display device comprising a substrate accommodating at least one light emitting electro-optical device and a fabric layer arranged on said substrate to receive at least part of the light emitted by said at least one light emitting electro-optical device. The fabric layer comprises a backside facing said substrate, which backside is provided with at least one self-supporting recess. Further, the fabric layer is arranged such that said at least one recess is located in front of said at least one light emitting electro-optical device, and such that a gap separates said at least one light emitting electro-optical device from the fabric material within said at least recess.

Light emitting electro-optical devices, such as for example light emitting diodes, typically are point like light sources which emits light in a sphere or half sphere pattern. Hence, the area illuminated by a single such electro-optical device increases with the distance to it. In many applications, it is desired to obtain an essentially homogenous illumination of an object, and in such applications where the display device further should have a textile appearance, a fabric may be arranged in front of the light emitting electro-optical devices in order to be illuminated to create the illusion of a light emitting fabric.

By ensuring a certain distance, a gap, between the light emitting electro optical device(s) and the illuminated fabric, the area that is illuminated is markedly larger than the size of the light source. This will increase the homogeneity of the fabric illumination, especially in cases where several discrete and spaced apart light sources are utilized to illuminate a fabric layer.

Further, fabric layer will diffuse the light emitted by the light emitting electro-optical device(s), so that diffuse light exits the display device.

By providing the fabric layer arranged on the substrate with self-supporting recesses and aligning the fabric on the substrate such that the recesses are arranged directly in front of the corresponding light-emitting electro-optical devices, the aforementioned desired distance, the gap, is obtained.

Typically, the front side of the fabric layer, opposite to said backside, comprises at least one protrusion, the location of which corresponds to said at least one recess on said backside.

In embodiments of the invention, the fiber density in a recess forming region of said fabric layer may be different from the fiber density in a region of said fabric layer adjacent to said recess forming region.

In embodiments of the invention, wherein said fabric layer is a knitted fabric layer, at least one of the needle paths, the loop length and the stitching density in a recess forming region of said fabric layer may be different from that in a region of said fabric layer adjacent to said recess forming region.

In embodiments of the invention, a translucent material may be arranged in said gap between said at least one light emitting electro-optical device and said fabric layer in said at least one recess.

A translucent material may be used to further ensure the desired distance between the light sources and the fabric layer, especially in cases where a mechanical force may be applied onto the fabric layer.

Said translucent material may, in embodiments of the invention, comprise a light scattering component.

When the translucent material comprises a light scattering component, light is be further scattered before reaching the fabric layer, thereby further improving the homogeneity of the light.

In embodiments of the present invention said substrate may be a flexible substrate adapted to be bent in at least one direction.

The fabric layer with the self-supporting recess is much advantageous in the case of a flexible display device, since the distance between the light emitting electro-optical devices and the fabric layer is maintained also during bending of such a display device.

In embodiments of the present invention, said substrate may comprise reflective portions.

In order to increase the light utilization efficiency, the substrate may comprise a reflective material in order to reflect light incident on the substrate towards the fabric layer.

In embodiments of the present invention, the display device may comprise a plurality of spaced apart light emitting electro-optical devices arranged in a pattern on said substrate, and said backside of said fabric layer comprises a plurality of recesses arranged in a pattern corresponding to said pattern of light emitting electro-optical devices such that each one of said recesses is arranged in front of a separate one of said light emitting electro-optical devices.

In a second aspect, the present invention relates to a textile product comprising at least one light emitting device of the present invention embedded in said product.

In a third aspect, the present invention relates to a method for the manufacture of a display device of the present invention, the method comprising: providing a substrate accommodating at least one light emitting electro-optical device; providing a fabric layer in which at least one self-supporting concave region is arranged, and arranging said fabric layer on said substrate such that said at least one self-supporting concave region is located in front of said at least one light emitting electro-optical device.

BRIEF DESCRIPTION OF THE DRAWINGS

This and other aspects of the present invention will now be described in more detail, with reference to the appended drawings showing a currently preferred embodiment of the invention.

FIG. 1 illustrates a cross sectional view of a display device of the present invention.

DETAILED DESCRIPTION

The present invention relates to a display device suitable for integration in, or constituting a textile product.

An exemplary embodiment of a display device according to the present invention is illustrated in FIG. 1 and comprises a substrate 100 accommodating a plurality of light emitting diodes (herein abbreviated LEDs) 101, 101'. On the substrate is arranged a fabric layer 102 which has a backside 103 facing the substrate 100.

A plurality of self-supporting recesses 104, 104' are arranged in the backside 103 of the fabric layer 102. The fabric layer 102 and the substrate 100 are mutually aligned such that each one of the plurality of self-supporting recesses 104, 104' are located in front of (i.e. counted in the main direction of light emission from the LEDs, typically along the normal of the substrate surface) a separate one of the plurality of LEDs 101, 101'. The area of a recess 104 arranged in front of a corresponding light emitting diode 101 is typically larger than the area of the light emitting diode, such that the light emitting diode is housed in the recess. The major portion of light emitted in a forward direction by the LEDs, i.e. in a direction away from the substrate 100, is emitted towards the inner walls of the recess arranged in front of it.

Often, the fabric layer is quite thin, and thus the self-supporting recesses 104, 104' in the backside 103 of the fabric layer 102 may result in corresponding protrusions 106, 106' on the front side 105 of the fabric layer 102.

The substrate 100 which accommodates the LEDs 101, 101' may be any substrate suitable as a substrate for use in a display device. Typically, it comprises a dielectric material provided with conductive lines (not shown) for driving the LEDs.

The LEDs are typically connected or connectable to a driving unit (not shown) via the conductive lines, and that driving unit may be arranged on the substrate 100 or may be separate there from.

In embodiments of the present invention, especially when the display device is intended as a flexible display device, the substrate 100 is a flexible substrate which is adapted to be bent in at least one direction, and typically so without breaking Examples of materials suitable for such flexible substrates are known to those skilled in the art and include fabric based substrates (for example where the conductive lines may be arranged on the fabric, as in embroidery or printing, or within the fabric material as in weaving the threads in the fabric) and substrates based on polymeric materials.

A portion of the light emitted by the LEDs 101, 101' may be scattered or reflected back towards the substrate 100, for example by means of scattering the fabric layer 102 or any material located between the LEDs and the fabric layer.

In order to increase the light utilization efficiency, it may thus be advantageous that at least portions of the substrate surface is reflective, such that light incident on the substrate surface is reflected back in the forward direction.

Depending e.g. on the substrate material of choice, the reflective properties may be achieved in different manners. For example, an inherently reflective substrate material may be chosen, the substrate material may be treated such that is obtains a reflective nature, or alternatively, reflective material may be arranged on the substrate surface.

For example, when a fabric substrate is chosen high luster fibers (silk, viscose), can be used, the fiber length, smoothness, cross-sectional shape (e.g. flat rather than circular) can be appropriately selected and a fabric finishing may be performed.

Luster enhancing finishes, resulting in reflective properties, can be used over the entire fabric as in glazed, Ciré (or hot glazed) or Schreiner finish. This type of finish can also be applied locally as in Moire and embossed finishing. These finishes are applied by calendaring. Different calendars produce different effects on the surface. Used in conjunction with a resin finish this effect can be made permanent. Another example is the use of Gelatin finish (on Rayon fabric) as it is a clear substance that enhances natural luster.

In the presently described embodiment, the display device comprises light emitting diodes (LEDs) 101, 101' as light emitting electro-optical devices. In the context of the present application, the term "light emitting diode" is intended to encompass all kinds of presently and in the future known types of light emitting, including, but not limited to inorganic based LEDs, organic based LEDs (OLEDs) and polymeric based LEDs (polyLEDs). Laser diodes are also encompassed by the collective term light emitting diode. In general, a "light emitting electro-optical device" is a device which emits light when an electrical current is passed through the device.

In the presently described embodiment, a plurality of light emitting diodes 101, 101' are arranged in a predetermined pattern on the substrate 100. However, the present invention also relates to the case where only one light emitting electro-optical device is arranged on a single substrate. Light emitted by the LEDs 101, 101' are typically emitted in a half sphere pattern. The fabric layer 103 placed over the substrate-LED aggregate. When the fabric layer 103 is arranged at a certain distance from the LEDs, the projection on the fabric layer of the light from the LEDs is enlarged.

The fabric layer can provide spacing between the LED containing layer and the user (whether from the visual point of view or applications in which the top layer is in contact with the user, e.g. the user's skin). According to the present invention, this spacing may be achieved by arranging on the substrate a fabric layer 102 wherein self-supporting recesses 104, 104' are arranged in the back side 103 of the fabric layer. The fabric layer may for example be of woven or non-woven fabric, single or multilayer weft and/or warp knitted fabric, as well as spacer fabrics.

Fabric materials suitable for use in the present invention include, but are not limited to, fabrics based on natural and synthetic fibers and mixtures of natural and synthetic fibers.

The surface structure (i.e. the self-supporting recesses in the backside and the optional corresponding protrusions on the front side) 104, 104' in the fabric layer 102 may be obtained in several different manners.

For example, domes in a knitted fabric as may be inserted/part of the fabric layer. By manipulating the needle path, the loop length and stitch density, various 3D surfaces, such as domes, can be knitted.

Alternatively, the surface structure could be generated by finishing (texturing). Various methods of texturing can produce localized raised parts on the textile layer that will function as the top layer. Examples are a variety of embossing methods (e.g. puckering or plissé in which localized caustic soda induced shrinkage causes raising of the structure in the areas that have not shrunk).

Further alternatively, the surface structure may be obtained by incorporating elastic yarn under tension into the fabric, such that when the tension on the elastic yarn is released, the yarns contracts, leading to the desired surface structure.

The term "self-supporting recesses" as used herein, refers to that the recesses are an intrinsic, essentially permanent feature of the fabric. The recesses are formed in the fabric before it is arranged on the substrate, either during the manufacture of the fabric it self, or as a post-fabrication processing step.

As mentioned above, there are many ways of obtaining the self-supporting recesses in the fabric layer. By some of these ways, the fiber density will differ between a recess forming region of the fabric layer and a region adjacent to such a recess forming region. For example, the fiber density can be adjusted in a knitting structure in order to achieve desired light output properties. For example, the fiber density may be higher in the recess forming regions, for example in order to provide high light diffusive properties, or may alternatively be lower in the recess forming regions to provide high light throughput. A lower fiber density in the recess-forming regions and a higher fiber density in the regions there between may further be used to prevent mixing of light from adjacent light sources, located beneath adjacent recesses.

Further, the fiber density, the needle path, the loop length and/or the stitch density may differ from one recess to another recess. Accordingly, the light output properties can be different in different portions of the fabric layer.

In order to maintain an acceptable light utilization efficiency, the fibers of the fabric layer is preferably non-absorbing or absorbing to only a small extent within the wavelength region of interest, typically the range of visible light.

When the fabric layer with structured surface(s) is arranged on the substrate, there is a distance, a gap, from a light emitting diode to the fabric material in the recess forming region located directly in front of the light emitting diode.

Due to this distance, the gap, between the light emitting diode and the diffusing material (i.e. the fabric layer), the light cone from the LED expands, illuminating an area of the fabric that is essentially larger than the area of the LED. From the outside of the device (viewing the front surface of the fabric layer), this creates the illusion of each light emitting diode being significantly larger than its actual size.

Since the recesses in the fabric layer are self-supporting, this gap between the LED and the fabric, as well as the effects associated with this gap, will be well defined. Further the gap will be retained even after the light source have been bent or stretched, as well as during the bending and stretching action. This is much desired when it comes to a textile product, especially wearable products, which will be bent and stretched during normal operations. Between the substrate 100 and the fabric layer 102 may optionally be arranged a translucent material 107 covering the light emitting diodes 101, 101'.

The translucent material 107 may have as a purpose to protect the LEDs 101, 101' from mechanical impact, hence increasing the mechanical resistance of the display device.

The translucent material 107 can also aid in maintaining the above mentioned gap between the LEDs and the fabric layer, especially during mechanical impact, bending, stretching and the like.

The translucent material 107 may for example be an elastomeric material which especially would be advantageous in the case when the display device is intended as a flexibel display device. Example of suitable such elastomeric materials include, but are not limited to PDMS (poly(dimethylsiloxane)) and other silicon based elastomers. Alternatively, the translucent material may be a fibrous material which is translucent. Other suitable translucent materials will be known to those skilled in the art.

The translucent material 107 may comprise a light scattering component, or may itself have scattering properties in order to pre-scatter the light from the LEDs before it encounters the fabric layer. Such scattering material typically consists of small particles of material that are reflective or has a refractive index different from that of the translucent material 107. Examples of such scattering component include, but are not limited to small particles of titanium oxide and phosphor particles, which may be used to convert the wavelength of the emitted light. Other suitable scattering components will be known to those skilled in the art.

The person skilled in the art realizes that the present invention by no means is limited to the preferred embodiments described above. On the contrary, many modifications and variations are possible within the scope of the appended claims. For example, the light-emitting electro-optical devices may be grouped together into a plurality of groups each containing more than one such group. Each of the recesses in the fabric layer may then be arranged to be located in front of a separate one of these groups of light-emitting electro-optical devices. For example, when the group of light-emitting electro-optical devices are arranged in a row, such as a linear array of LEDs, the recess in the fabric layer may be extended in the direction of the row, forming an extended groove in the fabric layer.

Display devices of the present invention may be used as or in lighting systems. Especially, display devices of the present invention may be used in textile products such as dynamic interior lighting systems at home or on the move (e.g. furniture upholsteries, curtains, carpets), wearable communication displays (e.g. in bags, jackets), photonic therapy devices (baby jaundice sleeping bag, acne treating t-shirt and accessories, wound healing plaster, etc.).

The invention claimed is:

1. A display device comprising:

a substrate accommodating at least one light emitting electro-optical device; and a knitted fabric layer arranged on said substrate to receive at least part of the light emitted by said at least one light emitting electro-optical device, wherein said knitted fabric layer comprises a backside facing said substrate and defining at least one pre-formed permanent self-supporting recess, wherein said recess is an intrinsic feature of the knitted fabric and is formed in the knitted fabric layer before the knitted fabric layer is arranged on said substrate, and wherein said knitted fabric layer is arranged such that said at least one pre-formed permanent recess is located in front of said at least one light emitting electro-optical device, and a gap separates said at least one light emitting electro-optical device from the knitted fabric layer within said at least one pre-formed permanent self-supporting recess and provides a certain distance between said at least one light emitting electro-optical device from the knitted fabric layer so that a light projection of the at least one light emitting electro-optical device on the knitted fabric layer is enlarged.

2. The display device according to claim 1, wherein said knitted fabric layer comprises a front side opposite to said back side, wherein said front side comprises at least one protrusion disposed for engaging said at least one recess on said back side.

3. The display device according to claim 1, wherein the fiber density in a recess forming region of said knitted fabric layer is different from the fiber density in a region of said knitted fabric layer adjacent to said recess forming region.

4. The display device according to claim 1, wherein at least one of a needle path, a loop length and a stitching density in a recess forming region of said knitted fabric layer is different from that in a region of said knitted fabric layer adjacent to said recess forming region.

5. The display device according to claim 1, wherein a translucent material is arranged in said gap between said at least one light emitting electro-optical device and said knitted fabric layer in said at least one recess.

6. The display device according claim 5, wherein said translucent material comprises a light scattering component.

7. The display device according to claim 1, wherein said substrate is a flexible substrate bendable in at least one direction.

8. The display device according to claim 1, wherein said substrate comprises reflective portions.

9. The display device according to claim 1 comprising a plurality of spaced apart light emitting electro-optical devices arranged in a first pattern, and wherein said backside of said knitted fabric layer comprises a plurality of recesses arranged in a second pattern corresponding to said first pattern of light emitting electro-optical devices, such that at least one of said recesses is arranged in front of at least one of said light emitting electro-optical devices.

10. A display device comprising:

a substrate accommodating at least one light emitting electro-optical device; and a knitted fabric layer arranged on said substrate to receive at least part of the light emitted by said at least one light emitting electro-optical device, wherein said knitted fabric layer comprises a backside facing said substrate and defining at least one pre-formed permanent self-supporting recess, wherein said recess is an intrinsic feature of the knitted fabric and is formed in the knitted fabric layer before the knitted fabric layer is arranged on said substrate, and wherein said knitted fabric layer is arranged such that said at least one pre-formed permanent recess is located in front of said at least one light emitting electro-optical device, thereby ensuring that a gap exists between said at least one light emitting electro-optical device and the knitted fabric layer within said at least one pre-formed permanent self-supporting recess and thereby providing that a certain distance exists between said at least one light emitting electro-optical device and the knitted fabric layer so that a light projection of the at least one light emitting electro-optical device on the knitted fabric layer is enlarged.

11. A display device comprising:

a substrate comprising a dielectric material;

at least one light emitting electro-optical device attached to said substrate; and a knitted fabric layer arranged on said substrate to receive at least part of the light emitted by said at least one light emitting electro-optical device, wherein said knitted fabric layer comprises a backside facing said substrate and defining at least one pre-formed permanent self-supporting recess, wherein said recess is an intrinsic feature of the knitted fabric and is formed in the knitted fabric layer before the knitted fabric layer is arranged on said substrate, and wherein said knitted fabric layer is arranged such that said at least one pre-formed permanent recess is located in front of said at least one light emitting electro-optical device, and a gap separates said at least one light emitting electro-optical device from the knitted fabric layer within said at least one pre-formed permanent self-supporting recess and provides a certain distance between said at least one light emitting electro-optical device from the knitted fabric layer so that a light projection of the at least one light emitting electro-optical device on the knitted fabric layer is enlarged.

* * * * *